US006771147B2

(12) United States Patent
Mongia

(10) Patent No.: US 6,771,147 B2
(45) Date of Patent: Aug. 3, 2004

(54) 1-100 GHZ MICROSTRIP FILTER

(75) Inventor: Rajesh Mongia, Plano, TX (US)

(73) Assignee: Remec, Inc., Del Mar, CA (US)

( * ) Notice: Subject to any disclaimer, the term of this patent is extended or adjusted under 35 U.S.C. 154(b) by 0 days.

(21) Appl. No.: 10/090,100

(22) Filed: Feb. 28, 2002

(65) Prior Publication Data

US 2002/0180569 A1 Dec. 5, 2002

Related U.S. Application Data

(60) Provisional application No. 60/341,571, filed on Dec. 17, 2001.

(51) Int. Cl.[7] ..... H01P 1/20

(52) U.S. Cl. ..... 333/204; 333/219; 333/205; 333/246

(58) Field of Search ..... 333/204, 219, 333/205, 246

(56) References Cited

U.S. PATENT DOCUMENTS

| | | | | | |
|---|---|---|---|---|---|
| 3,754,198 | A | * | 8/1973 | Anghel | 333/204 |
| 4,281,302 | A | * | 7/1981 | Stegens | 333/204 |
| 4,713,634 | A | * | 12/1987 | Yamamura | 333/245 |
| 5,798,677 | A | * | 8/1998 | Cook | 333/204 |
| 5,825,263 | A | * | 10/1998 | Falt | 333/204 |
| 6,067,461 | A | * | 5/2000 | Ye et al. | 333/204 |
| 6,370,404 | B1 | * | 4/2002 | Shen | 333/204 |

FOREIGN PATENT DOCUMENTS

| | | | | | |
|---|---|---|---|---|---|
| GB | 2153155 | A | * | 8/1985 | 333/204 |

OTHER PUBLICATIONS

Chang et al., "A Modified Parallel–Coupled Filter Structure That Improves the Upper Stopband Rejection and Response Symmetry", IEEE Trans. on Microwave Theo. & Tech., vol. 39, No. 2, Feb. 1991, pp. 310–314.*

PCT: Notification of Transmittal of the International Search Report, dated Apr. 14, 2003.

Chang and Itoh, "A Modified Parallel–Coupled Filter Structure that Improves the Upper Stopband Rejection and Response Symmetry," IEEE Transactions on Microwave Theory and Techniques, vol. 39, No. 2, Feb. '91.

Gupta, et al, "Microstrip Lines and Slotlines", Library of Congress Cataloging–in–Publication Data, 2nd Ed., '96 Artech House, Inc., pp. 182–189.

Mongia, et al, "RF and Microwave Coupled–Line Circuits", Library of Congress Cataloging–in–Publication Data, '99 Artech House, Inc., pp. 98–101 and 182–183.

* cited by examiner

*Primary Examiner*—Robert Pascal
*Assistant Examiner*—Kimberly E Glenn
(74) *Attorney, Agent, or Firm*—Jenkens & Gilchrist

(57) ABSTRACT

A high frequency filter design for the GHz frequency range is provided. The high frequency filter comprises at least a microstrip design that incorporates both transverse and lateral couplings between the filters resonators. The high frequency filter further incorporates an opened or fully enclosed enclosure over the strip line or microstrip circuitry and may be manufactured on a relatively thick dielectric substrate having a thickness that is greater than about a twentieth of the filter's band-pass wavelength in the dielectric substrate. The high frequency filter design provides a small, easily reproducible filter design better than prior art microstrip filters.

37 Claims, 7 Drawing Sheets

1-100 GHZ MICROSTRIP FILTER

This application claims the benefit of provisional application 60/295,207 filed Dec. 17, 2001.

BACKGROUND OF THE INVENTION

1. Technical Field of the Invention

The present invention relates generally to high frequency filters. More specifically, the present invention relates to high frequency filters in the 1 GHz to 100 GHz range that utilize patterned resonators formed on a dielectric substrate.

2. Description of Related Art

High frequency filters, such as low-pass, high-pass, band-pass, and notch filters, are very important components of modern communication systems. In particular, wireless, mobile, and optical communication systems utilize band-pass filters for isolating particular frequency channels. The frequency channels presently of interest are in a range of between 1 GHz and 100 GHz. Band-pass filters allow signals in a certain frequency band (in band frequencies) to be transmitted through the band-pass filter with minimal attenuation. The band-pass filter strongly attenuates other undesired frequencies (out of band frequencies). In the range of frequencies extending from about 1 GHz to about 100 GHz, various different types of high frequency filters have been used. The types of high frequency filters presently being used include waveguide filters, dielectric resonator filters, combline filters, microstrip filters, etc. To date waveguide filters and dielectric resonator filters have been the preferred style for obtaining high performance in the 1–100 GHz range because of their low signal attenuation in the pass band and high rejection characteristics in the out of band frequencies. Drawbacks of these waveguide and dielectric resonator filters is that they are relatively expensive, require tuning after manufacturing and are bulky in size.

Therefore, what is needed is a low cost, relatively small size filter that operates in the 1–100 GHz range that does not require tuning and has operating characteristics with low attenuation in the pass band and high rejection in the out of band frequencies.

SUMMARY OF THE INVENTION

Exemplary embodiments of the present microstrip filter operates in the 1 to 100 GHz range. Exemplary filters do not require tuning and provide relatively low loss filtering in the band pass ranges and high rejection in the out of band frequencies. Embodiments of the present inventive filter are formed on a relatively thick dielectric substrate and comprise a plurality of resonators wherein at least one of the resonators have both transverse and longitudinal gaps associated with them. Furthermore, one or more of the resonators may have a varying width over its length. In some embodiments, a "dog house" or tunnel like enclosure covers the resonators such that there are openings in the tunnel like cover substantially near the input and output portions of the exemplary filter. In other embodiments an enclosure covers all the resonators and there are no openings near the input and output portions of an exemplary filter. An exemplary filter provides a very low insertion loss of about 1 dB in the mid band of the filter. The filter can provide a very steep roll off "steep skirts" of more than 30 dB in less than 1 GHz as the filter transitions from the pass band to the stop band. In essence the present invention provides an inexpensive, easily repeatable solution to the need for a small, low loss filter used in the GHz frequency range.

BRIEF DESCRIPTION OF THE DRAWINGS

The disclosed invention will be described with reference to the accompanying drawings, which show important sample embodiments of the invention and which are incorporated in the specification hereof by reference, wherein.

DETAILED DESCRIPTION OF THE PRESENTLY PREFERRED EXEMPLARY EMBODIMENTS

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Microstrip filters occupy a smaller volume than waveguide cavity filters and dielectric resonator filters. Generally, microstrip filters use well known printed circuit techniques for their fabrication. Microstrip filters are inexpensive to manufacture and easily reproducible. Prior microstrip filters utilized a single type of coupling between resonators. For example the filter may only utilize transverse couplings or only utilize longitudinal couplings. The use of both transverse and longitudinal couplings in a single microstrip filter has not been utilized successfully to date. A drawback of microstrip filters is that their performance in the pass band and in the out of band frequencies is not as good as that of waveguide, or dielectric resonator filters. In fact, microstrip resonator filters provide a lower "quality factor" and hence provide greater attenuation in the pass band frequencies than the waveguide, and dielectric resonator filters. The characteristic attenuation of prior microstrip filters tends to degrade the overall performance of the system that the filter is being used in. For example, a high attenuation for in-band (pass band) signals increases the noise figure of a receiver when a microstrip filter is used in the receiving circuitry (the receive chain). The attenuation also decreases the output power of a transmitter when the microstrip filter is used in the transmitter circuitry (the transmit chain). Despite the disadvantages of having a lower quality factor, microstrip filters designed to operate in the 1 to 100 GHz frequency range are very popular in RF and microwave systems. The popularity exists because of the ease of the printed circuit manufacturing techniques, reproducibility, the small size, low cost and ease of integration that the microstrip filters provide.

An embodiment of the present invention provides a microstrip style filter that can be designed to operate in the 1 to 100 GHz frequency range. Unlike previous microstrip filters, embodiments of the present invention provide a microstrip-style filter that has a high quality factor(Q). The quality factor of an exemplary filter is approximately in the range of 300 to 800. As such, embodiments of the present invention can provide very little attenuation in the pass band, a steep transition to the out of band frequencies, they do not require tuning after manufacturing and are greatly improved over prior microstrip style filters.

Figure 1:
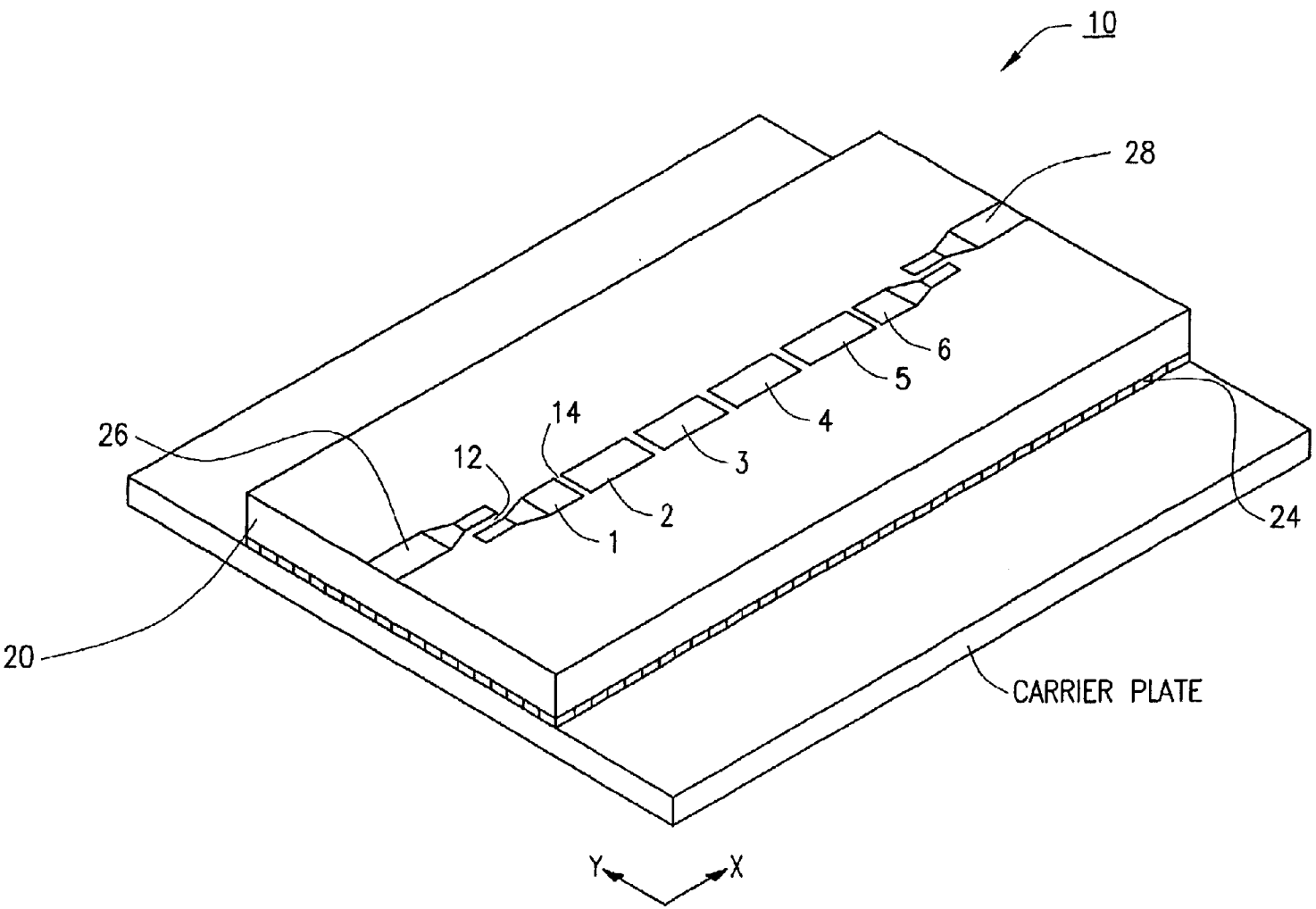
FIG. 1 is an oblique diagram of an exemplary filter in accordance with an embodiment of the present invention

Referring now to FIG. 1, an exemplary microstrip style filter 10 in accordance with the present invention is depicted. The microstrip structure on the disclosed device comprises two types of microstrip resonator couplings. The two types of couplings are transverse couplings 12 and longitudinal couplings 14. Preferably the transverse and longitudinal couplings are substantially perpendicular to each other. The importance of the combinational transverse-longitudinal couplings will be described in more detail below. The exemplary transverse-longitudinal microstrip filter 10 comprises six resonators denoted by 1, 2, 3, 4, 5 and 6. The exemplary filter 10 therefore behaves as a six pole filter. The number of resonators generally defines the number of poles the filter has. Of the six resonators, the end resonators are of non-uniform width. The width is denoted in the y-dimension of the resonator. Resonators 2, 3, 4 and 5 each have a uniform width denoted by WF.

The length of the resonators is denoted in the x-direction. The length of each resonator is approximately one half the wavelength of the filter's center frequency. The wavelength is as described below. When the filter 10 is in operation, the resonators 1, 2, 3, 4, 5 and 6 are excited in each of their fundamental modes. During operation, electric field lines start from a strip conductor (a resonator) and terminate on the surrounding conductors. The resonators are on top of a dielectric material block 20 (See FIGS. 1 and 2). Electric field lines passing through the dielectric material block 20 are near vertical at the center of the strip conductor resonator. Although a majority of electric field energy is stored in the dielectric material block 20, a significant electric field may exist in the air regions surrounding the conductor resonator. Since each resonator 1–6 is open at either end of its length, each resonator acts electrically as a shunt resonator that can be electrically represented as a parallel LCR circuit at and around its resonate frequency. The length of resonators 2, 3, 4 and 5 is denoted by L2, L3, L4 and L5, respectively.

For the lowest quasi-TEM mode of propagation, the wavelength is given by:

$$\lambda_g = c/f\sqrt{\epsilon_{eff}}$$

where c denotes the velocity of light in free space, f denotes the frequency of operation and $\epsilon_{eff}$ denotes the effective dielectric constant. $\epsilon_{eff}$ depends on the dielectric constant of the dielectric material block 20, the geometric parameters of the circuit, and the frequency of operation. The relative distribution of electric energy in the dielectric and air regions 14 determines the value of $\epsilon_{eff}$.

The size of the longitudinal gap between resonators 1 and 2 is denoted by G1; the size of the longitudinal gap between resonator 2 and 3 is denoted by gap G2; between resonator 3 and 4 by gap G3; between resonators 4 and 5 by gap G4; and between resonators 5 and 6 by gap G5. The capacitance between the various gaps provides the desired coupling between the resonators. Due to the electromagnetic nature of the couplings, a finite amount of coupling may also exist between non-adjacent resonators. The couplings between non-adjacent resonators can lead to filter characteristics that are different from Chebyshev or maximally flat characteristics.

The response of an exemplary filter 10 depends on the inter-resonator couplings between the various resonators (1–6) and the couplings of the end resonators (1 and 6) to the input and output transmission lines 26 and 28. Since the coupling between the input and output transmission lines (26, 28) and the end resonators 1, 6 are transverse couplings 12, the amount of coupling can be determined, in a practical case, by determining the even-and odd-mode impedance and the effective dielectric constants of the coupled lines. The knowledge of even-and odd-mode parameters along with the physical length of the structure can be used to determine the couplings (see, R. K. Mongia, I. J. Bahl and P. Bhartia, *RF and Microwave Coupled-Line Circuits*, Artech House, Norwood, Mass. 1999). Simple formulas for determining the even- and odd-mode parameters of coupled microstrip lines are also available in the same literature which is incorporated herein by reference. On the other hand couplings between the adjacent resonators 2, 3, 4, and 5 can be determined by determining the capacitance of the gaps between the resonators. Once the gap capacitance is known, the coupling can be determined. Extensive information exists in the literature about the capacitance of gaps in microstrip transmission lines (see, e.g. K. C. Gupta et al., *Microstrip Lines and Slot Lines*, Artech House, Norwood, Mass. 1996, Second Edition).

Although it is not essential to embodiments of the present invention, a filter 10 may have a physical symmetry about a mid-plane. For example, the embodiments shown in FIGS. 1 and 2 have a symmetry about a mid-plane denoted as PP'. The symmetry establishes an exemplary filter in which the structure shown on the right side of plane PP' becomes the mirror image of the structure shown on the left-hand side of plane PP'. More specifically, in the case of symmetry, gaps G1 and G5 are substantially equal. Furthermore, gaps G2 and G4 are substantially equal, and resonator lengths L1 and L6, L2 and L5, and L3 and L4 are substantially equal respectively. It is understood that although the dimensions are designed to be equal, the actual dimensions of the resonators and gaps may differ slightly in an actual exemplary filter due to dimensional tolerances from manufacturing. It is also noted that essential aspects and advantages of the present invention are not necessarily compromised if a filter in accordance with the present invention is not physically symmetrical.

Figure 2:
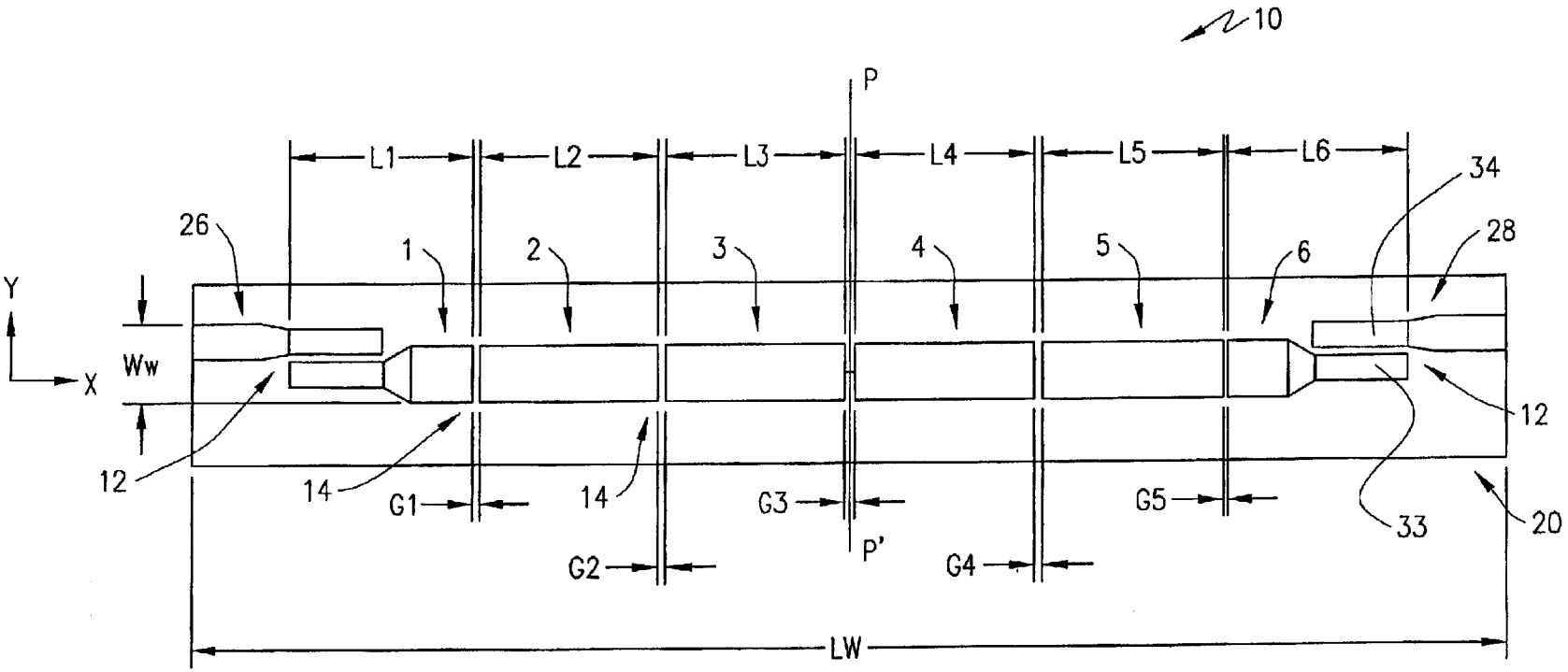
FIG. 2 is a top view of an exemplary microstripline layout in accordance with an embodiment of the present invention.

Referring still to FIGS. 1 and 2, the dielectric block 20 is depicted. On one surface of the dielectric block, the top surface, the metal filter resonator pattern (1–6, 26, 28) is printed. The second surface, the bottom surface, of the dielectric block 20 is completely metalized 24. The input portion 26 and output portion 28 are at either ends of the resonator pattern. In this filter embodiment, because of the symmetry about the PP' plane, the input portion 26 and output portion 28 are interchangeable.

Figure 3:
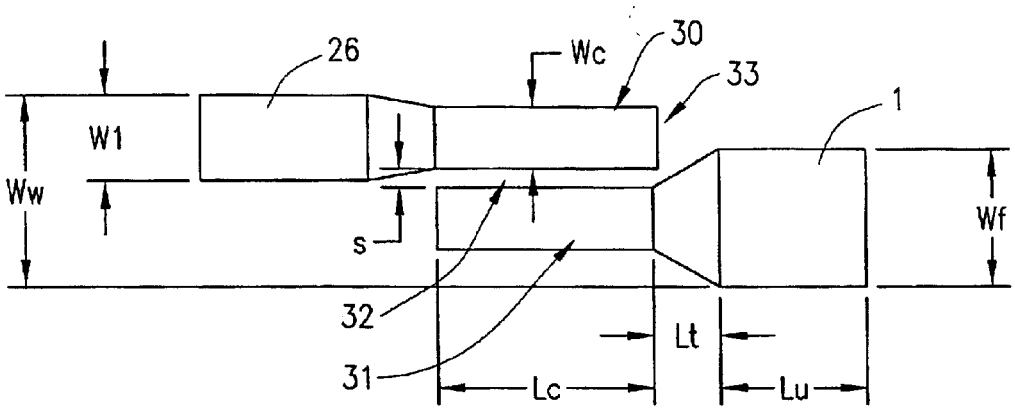
FIG. 3 is a top view of an exemplary layout of an exemplary transverse coupling of a filter in accordance with the present invention.

FIG. 3 provides enlarged detail of the exemplary input section 26 and first resonator 1 of FIG. 1. The transverse coupling 32, between the input 26 and the first resonator 1, is substantially perpendicular to the longitudinal couplings 14. As such the input portion 26 is terminated, basically as an open circuit in portion 33. The transverse coupling 32 from the input portion 26 to the first resonator results from portions 30 and 31. The length of the coupled section is Lc which is preferably approximately one-quarter of the filters center frequency wavelength long (one-quarter wavelength). The one quarter wavelength long section provides the maximum transverse coupling, but other lengths may also be used. The exemplary end resonators 1 and 6 each have a non-uniform width. The exemplary arrangement comprises three sections of length Lc, Lt and Lu. The non-uniform width resonator 1 aids in controlling the coupling between the input section 26 and the first resonator 1 as well as the coupling between the first resonator 1 and the second resonator 2. For example, the width Wc controls, in part, the maximum coupling between the input portion 26 and the first resonator 1 (the input coupling). Furthermore, the coupling between resonators 1 and 2 is controlled, in part, by the width Wf (inter-resonator coupling). By choosing different values of Wc and Wf, the input coupling and the inter-resonator coupling can be independently controlled. Generally, the width Wf is larger than Wc. Choosing a relatively large value of Wf helps in increasing the value of the quality factor (Q). Similarly, the nonuniform width resonator 6 helps in controlling, in part, the maximum coupling between the output portion 28 and transverse couplings 33 and 34 via the last resonator 6.

Some exemplary approximate dimensions of the exemplary filter of FIGS. 1 and 2 for operation in X-band frequencies are:

dielectric block: 35 mil thick alumina

W1=30 mil, Wc=30 mil, Wf=45 mil, Lc=100 mil, Lt=30 mil, Lu=70 mil, L2=L5=200 mil, L3=L4=200 mil, S=2 mil, G1=G5=2 mil, G2=G4=10 mil, G3=15 mil.

An advantage of utilizing both transverse and longitudinal couplings was discovered through experimentation. The transverse coupling between the input portion and the first resonator is much larger than if only longitudinal couplings were used between the first resonator and second resonator. Therefore, one can design the filter to have a wider bandwidth which one could not do if only longitudinal coupling is used. Thus, an advantage of embodiments of the present invention is that more flexibility is incorporated into the design of microstrip style filters so that more bandwidth is available. Another advantage of utilizing both transverse and longitudinal couplings in the exemplary filters is that the resulting filter is shorter than if only longitudinal couplings were used. Furthermore, the resulting filter is narrower than if only transverse couplings were used.

Figure 4A:
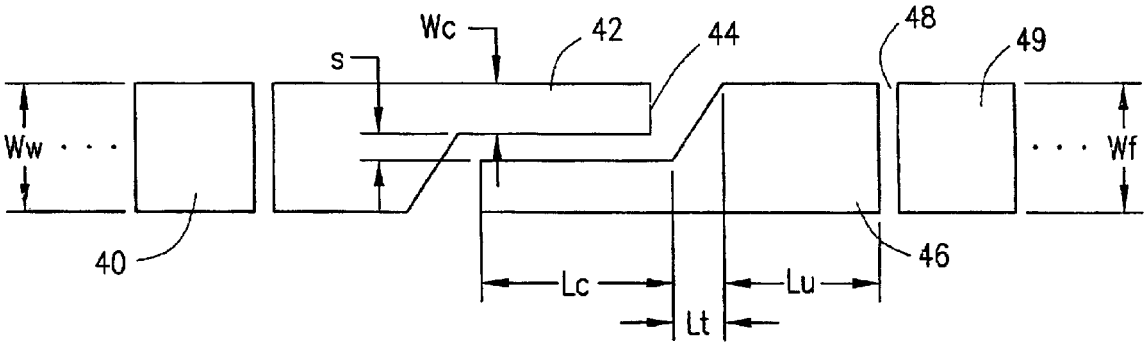
FIG. 4*a* is another exemplary transverse coupling in accordance with the present invention.

FIG. 4*a* depicts another exemplary arrangement of the transverse-coupling and longitudinal coupling combination in accordance with the present invention. The exemplary arrangement, in accordance with the present invention can be utilized to narrow the total width Ww of the filter such that Ww is substantially equal to Wf, shorten the total length Lw of the filter, and improve performance.

Here the input portion 40 narrows on one side to the transverse coupling portion 42. The transverse coupling gap 44 is substantially centered within the width Ww of the resonators. The first resonator 46 comprises a narrow portion and widens in a manner substantial opposite to the input portion prior to establishing the longitudinal gap 48 between first resonator portion 46 and the second resonator portion 49.

It is understood that embodiments of the present invention are not limited to bandpass filters. Instead low pass, high pass, notch and other types of filters can be created using the present invention.

Figure 4B:
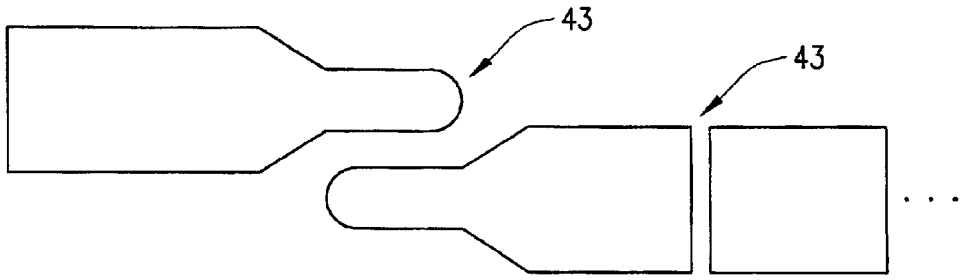
FIG. 4*b* is another exemplary transverse coupling in accordance with the present invention.

FIG. 4*b* depicts a transverse coupling resonator and longitudinal resonators having slightly rounded corners 43. The rounded corners provide advantages when the filter is operating in higher power systems. It is understood that virtually any of the corners in the filter may be blunted or rounded.

Figure 5:
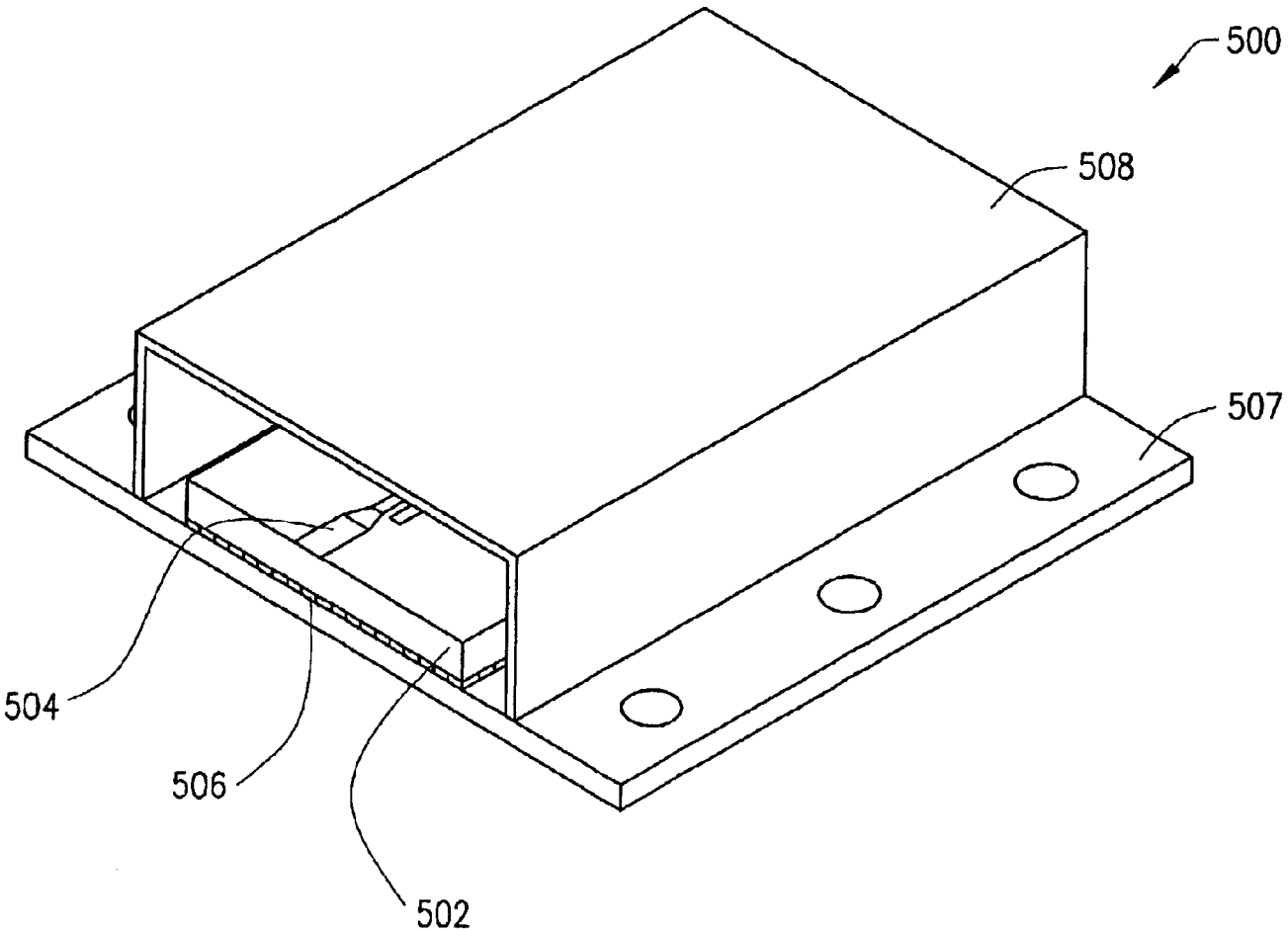
FIG. 5 is an oblique view of another embodiment of a filter in accordance with the present invention.

FIG. 5 depicts an exemplary perspective view of a filter 500 in accordance with the present invention. A manufactured exemplary filter comprises a rectangular dielectric block 502. The dielectric block generally comprises a top side and a bottom side. Both the top side and the bottom side provide planar surfaces. On the top side of the dielectric block a metal pattern 504 is produced by a suitable means such as by utilizing thin film techniques. The metal pattern 504 comprises the input, output and resonator portions of an exemplary filter. A metalized layer 506 completely covers the bottom (the opposite side) of the dielectric block 502. The dielectric block material should have a low dissipation factor at microwave frequencies. Commonly used materials for dielectric blocks in the microwave frequency range are alumina, quartz, glass, teflon (teflon based materials such as RT duriod®), barium tetratitanate or reasonable facsimiles or derivations thereof. The most commonly used dielectric block material used for microwave frequencies has a dielectric constant in the range of 2 to 40. It is understood that exemplary embodiments of the present invention may utilize dielectric materials having a dielectric constant outside of the commonly used range.

Prior to the present invention, high frequency microstrip filters were preferably fabricated on electrically thin dielectric substrates. The electrically thin dielectric substrates were chosen so as to keep the mode of propagation in a quasi-TEM mode. The thickness of the prior electrically thin dielectric substrates was chosen to be less than about one twentieth of the wavelength to be used in the dielectric material on which the circuit is fabricated.

In contrast to various prior microstrip filters, exemplary embodiments of the present invention use relatively thick dielectric substrate blocks 502. Such blocks are thicker than about one twentieth of the wavelength to be used in the fabricated filter. For example at X-band which has a wavelength range of about 3.75 cm to 2.5 cm in air, an exemplary filter's alumina dielectric substrate block 502 is chosen to be around 35 mils thick which is greater than one-twentieth of the wavelength of X-band signals in alumina.

One of ordinary skill in the art understands that in a dielectric substrate, the wavelength of a signal is reduced when compared to its free-space value. The wavelength is reduced by a factor equal to the square root of the dielectric constant of the substrate. For example, in an alumina substrate, which has a dielectric constant of nearly 10, the wavelength is reduced by a factor of about three (3) when compared to the free-space value. For example, the wavelength of a 10 GHz signal in free-space is about 3 cm, however the wavelength of the same 10 GHz signal in alumina is about 1 cm.

There are various manufacturing methods for creating a metalization pattern 504 on a dielectric block 502. Among them are the thin film deposition techniques which include sputtering, vacuum evaporation and subsequent plating techniques; thick film techniques wherein the metal pattern is screen printed on the dielectric; and printed circuit board fabrication techniques, etc. Exemplary embodiments of the present invention often require tight tolerances and dimensions on the circuitry. As such, thin film deposition techniques are generally preferred.

When metal is deposited on a dielectric surface using thin film techniques, generally a seed layer of adhesion material, such as titanium tungsten, is deposited first. The adhesion layer helps create a strong bond between the dielectric surface and the added metalization layers. A thin barrier layer of nickel may then be deposited on top of the adhesion material. Finally, a sufficiently thick layer of high electrical conductivity material, such as gold, is deposited on top of the barrier layer. The thickness of this high conductivity layer is at least a few RF skin depths. Skin depth represents the distance in a metal in which electromagnetic fields decays by a factor of about 2.78 from its value at the surface of the metal. For non-magnetic metals, the skin depth depends on the conductivity of the metal and the signal frequency being used. For example, the skin depth of gold at a frequency of about 10 GHz is about 0.7 microns. The back side of the dielectric block (the side opposite the metalization pattern) is generally completely The back side of the dielectric block 502 may be attached to a carrier plate 507 by any suitable means such as epoxy, solder, or other attachment methods and means. The carrier plate 507 is preferably made of a suitable material such that it has a thermal expansion coefficient that is similar to that of the dielectric block. Mechanical stresses produced in the dielectric block when the assembly expands or contracts due to variations in temperature are greatly reduced when the carrier plate and the dielectric block have similar thermal expansion coefficients. Some suitable exemplary carrier plate materials are kovar, copper tungston, copper-moly, steel, etc. The carrier plate may be electroplated with a suitable material or materials in order to increase the surface conductivity and reduce overall performance losses of the filter. It is specifically noted that the carrier plate may be fabricated out of non-metal materials also. An electrically insulating material whose surfaces can be suitably metalized can be used as a carrier plate. If the carrier plate is conductive, then the metalized layer 506 may not be required an exemplary filter 10. It is further understood that in some cases, the filter's substrate may be directly attached to the aluminum housing. When the size of the substrate is small enough, its expansion coefficient will not effect enough stresses.

Figure 8:
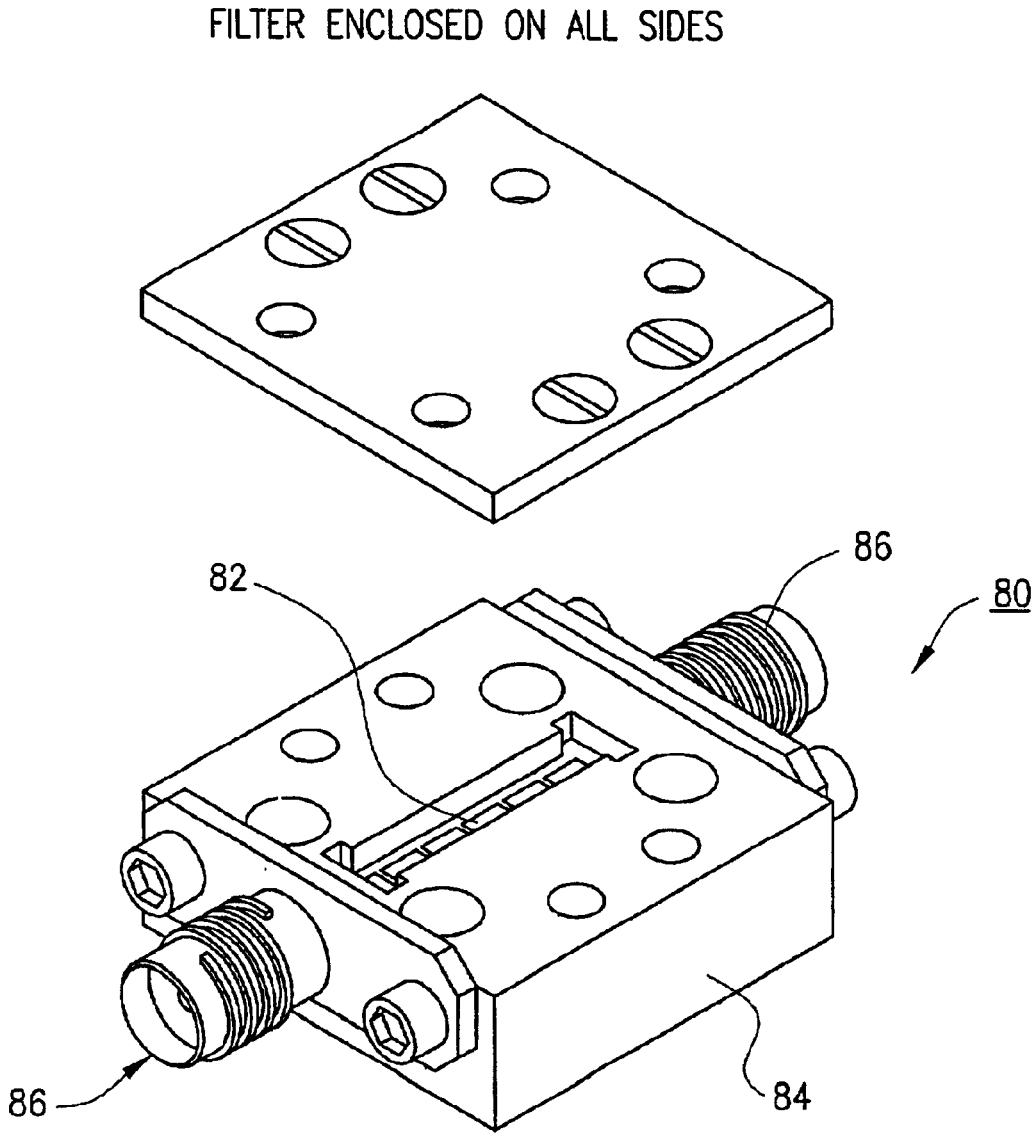
FIG. 8 depicts another embodiment of the present invention.

Referring to FIG. 8, an exemplary device 80 may be packaged as a stand alone unit wherein the filter 82 is housed in a metalic enclosure 84. Coaxial conectors 86, or other appropriate type connectors are used to provide input and output connections to the input and output portions of the filter 82. For example, the center conductors of the coaxial connectors make appropriate contact with input 26 and output 28 lines on the filter substrate. The exemplary filter may use any type of acceptable interface for microstrip circuits. Such interfaces include without limitation microstrip to microstrip, microstrip to wave-guide, microstrip to coaxial, and microstrip to surface mount interfaces.

Referring to FIG. 5, without being too redundant, connectivity to the input and output sections of the filter can be made using coaxial launchers or any other suitable means known to one skilled in the art of coupling microstrip circuits. The circuit is preferably housed in a metallic enclosure 508 (dog house) to reduce electrical interference and radiation. The dimensions of the enclosure have an effect of the frequency response of the filter. The enclosure 508 is generally plated with a high electrical conductivity material. It is noted that the exemplary enclosure need not be closed on all sides. The enclosure 508 preferably has open sides adjacent to the input and output portions is depicted. The enclosure 508 may also be a cap covering to totality of the upper portion of the circuit or it may be an overhang that is attached along one side of the circuit and hangs over the resonators.

The enclosure 508 operates as a pseudo waveguide and thus acts as a high-pass filter. The size of the enclosure must be properly dimensioned for the bandwidth of interest during initial design, experimentation, and calibration of an original exemplary filter design. It was discovered that by placing the enclosure 508 closer and/or further away from the filter resonators changes the rejection of out-of-band frequencies. Unexpectedly, the positioning of the enclosure further enhanced the steepness of the transition characteristics (steep skirts) from the pass-band to the stop-band(s). The dimensions of the enclosure are chosen such that the cutoff frequency of the enclosure is higher than the frequency of operation of the filter. In general the distance between an enclosure wall and an edge (or surface) of the microstrip line is about at least three times the substrate thickness. Techniques for modeling these results are being researched by the inventors. In exemplary embodiments the transition from pass-band to the stop-band could be in the range of 30 to 50 Db down at one or two gigahertz from the filters center frequency.

Figure 6:
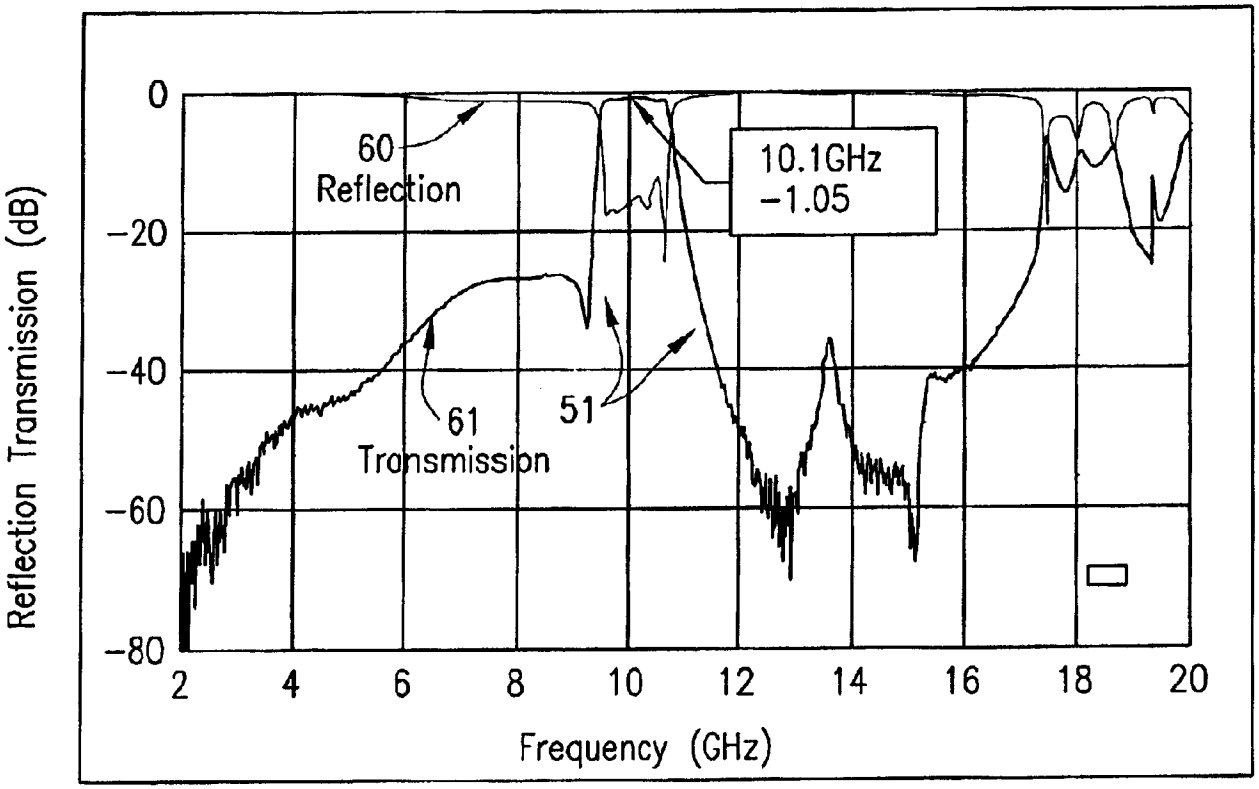
FIG. 6 is a graphical depiction of the frequency response of a 6-pole filter in accordance with the present invention.

FIG. 6 depicts the measured performance from a typical six-pole filter in accordance with the present invention and FIG. 5. The exemplary filter has a center frequency of about 10 GHz. The reflection of the signal is shown as plot 60. The transmission of the filter is shown as plot 61. The insertion loss of the filter is very low at about 1 dB in the mid-band of the filter. The return loss is less than about 15 dB in the mid-band of the filter. The rejection of out-of-band signals is impressive at about 25 dB for stop-band frequencies that are lower than the center frequency of the filter. For stop-band frequencies larger than the center frequency, the rejection is more than 30 dB for frequencies up to about 1.6 times the center frequency. The filter has very steep transition characteristics (steep skirts) for a microstrip filter from the pass-band to the lower stop-band frequencies and has a transmission zero close to the band-pass frequency range. The steep skirts 51 were an unexpected result of the exemplary filters. The steep characteristics 51 are a useful feature of the exemplary filter frequency response because the steep characteristics aid in rejecting undesired signals in the frequency range close to the pass-band of the filter. The unexpected steep characteristics of the present exemplary filter design may reduce the need for a higher order, more expensive and larger size filter that would have formerly been required to achieve similar specification results with a prior microstrip filter. As such embodiments of the present invention can provide better the performance over prior art microstrip filters.

Figure 7:
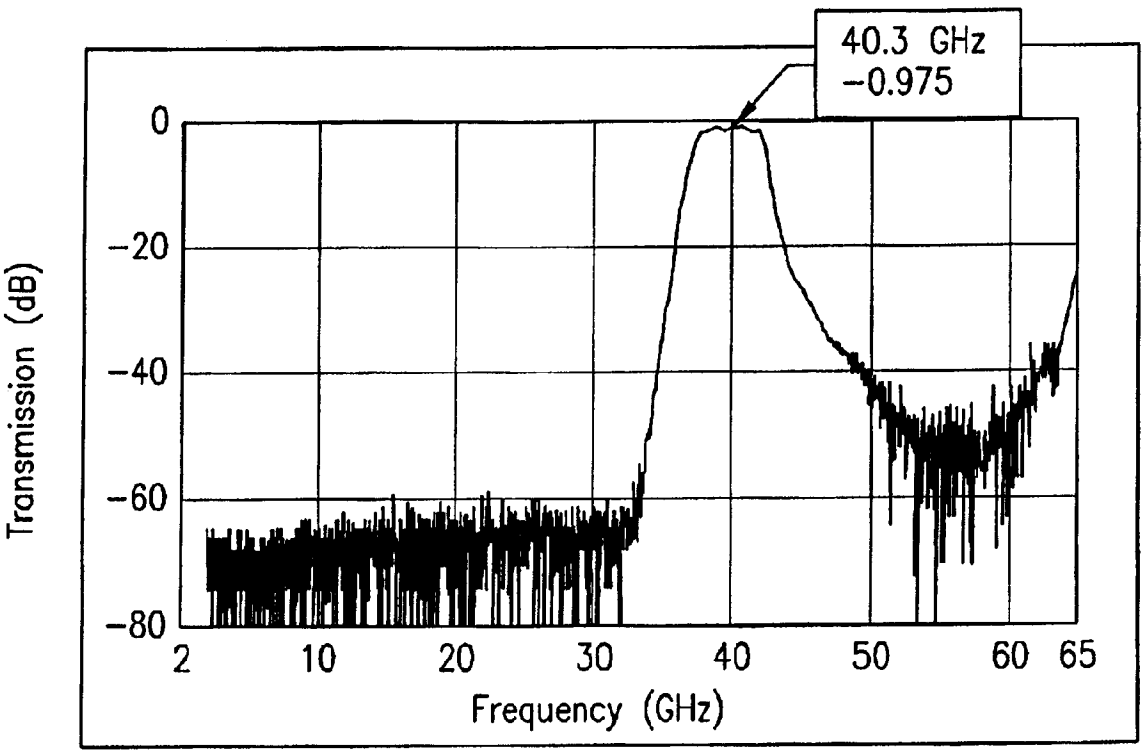
FIG. 7 is another graphical depiction of the frequency response of a filter in accordance with the present invention.

FIG. 7 depicts the measured performance from a typical six-pole microstrip filter in accordance with the present invention and in a complete enclosure as depicted in FIG. 8. The center frequency for this filter is 40.3 GHz. Here the insertion loss is again very low at about 1 dB in the middle band of the filter. The rejection of out-of-band signals is very impressive at about 60 dB for frequencies lower than the center frequency. For out-of-band frequencies that are higher than the center frequency, the rejection is about 50 dB. The transition from stop-band to pass band is very steep at about 5–7 GHz on either side of the center frequency.

It is understood that the present invention may be utilized in various stripline technologies. As will be further recognized by those skilled in the art, the innovative concepts described in the present application can be modified and varied over a wide range of applications. Accordingly, the scope of patented subject matter should not be limited to any of the specific exemplary teachings discussed, but is instead defined by the following claims.

What is claimed is:

1. A microstrip filter adapted to operate in a frequency range between 1 and 100 GHz, said microstrip filter comprising:

a plurality of resonators having a longitudinal gap between each one of said resonators, an input portion having a first transverse gap between said input portion and a first one of said plurality of resonators, a dielectric block having said plurality of resonators on a first side, dielectric block being at least one-twentieth of the microstrip filter's pass-band frequency's wavelength in the dielectric block, and an enclosure at least partially covering said plurality of resonators, said enclosure operating as a pseudo waveguide having a cutoff frequency that is higher than an operating frequency of said microstrip filter.

2. The microstrip filter of claim 1, wherein said enclosure has a length dimension and is open at opposite ends of its length.

3. The microstrip filter of claim 1, further comprising an output portion having a transverse gap between said output portion and a last one of said plurality of resonators.

4. The microstrip filter of claim 3, wherein said enclosure is open near a least one of said input portion and said output portion.

5. The microstrip filter of claim 4, wherein said enclosure substantially encloses said plurality resonators.

6. The microstrip filter of claim 1, wherein said microstrip filter is adapted to operate frequency range between 1 GHz and 25 GHz.

7. The microstrip filter of claim 6, wherein said dielectric block has a thickness ranging from about 200 mils to about 15 mils.

8. The microstrip filter of claim 1, wherein said dielectric block has a thickness of between 200 mils and 15 mils the microstrip filter is adapted to operate in a frequency range between 1 GHZ and 25 GHz.

9. A high frequency filter comprising:

a dielectric substrate having a top side and a bottom side, the thickness of said dielectric substrate, from said top side to said bottom side, is at least one-twentieth of the high frequency filter's pass-band frequency's wavelength in said dielectric substrate;

an input portion on said top side of said dielectric substrate, a first resonator portion spaced transversely from said input portion and on said top side;

a second resonator portion spaced longitudinally and on said top side; and one or more additional resonators spaced longitudinally from said second resonator and each other respectively, said one or more additional resonators being on said top side;

an output portion on said top side of said dielectric substrate, said output portion being spaced transversely from a one of said one or more additional resonators, an open ended enclosure over at least said first resonator, said second resonator, and said one or more additional resonators, said open ended enclosure adapted to operate as a pseudo-wave guide having a cut off frequency above an operating frequency of said high frequency filter.

10. The high frequency filter of claim 9, further comprising a ground plane on said bottom side of said dielectric substrate.

11. The high frequency filter of claim 8, wherein said enclosure is open adjacent to said input portion.

12. The high frequency filter of claim 11, wherein said enclosure comprises a conductive material on a surface of said enclosure.

13. The high frequency filter of claim 9, further comprising a carrier plate, said dielectric substrate being attached to said carrier plate.

14. The high frequency filter of claim 9, wherein said filter is at least one of a band-pass, low pass and a high pass filter.

15. The high frequency filter of claim 9, wherein said filter is at least one of a strip line filter and a microstrip filter.

16. The high frequency filter of claim 9, wherein at least one of said first, second and third resonators have a variation in their width over their length.

17. The high frequency filter of claim 9, wherein said high frequency filter is adapted to operate at frequencies substantially between 1 GHz and 100 GHz.

18. The high frequency filter of claim 9, wherein said high frequency filter is adapted to operate in a frequency range between 1 GHz and 25 GHz.

19. The high frequency filter of claim 18, wherein said dielectric block has a thickness ranging from about 200 mils to about 15 mils.

20. The high frequency filter of claim 9, wherein said dielectric block has a thickness of between 200 mils and 15 mils and the microstrip filter is adapted to operate in a frequency range between 1 GHz and 25 GHz.

21. An electronic system that is adapted to process high frequency signals comprising:

a high frequency filter, said high frequency filter comprising:

a dielectric substrate having a top surface and a bottom surface, the thickness of said dielectric substrate, from said top surface to said bottom surface, being at least one-twentieth of the high frequency filter's pass-band frequency's wavelength in said dielectric substrate;

a plurality of resonators spaced from each other on said top surface and adapted to be longitudinally coupled;

an input portion spaced from a first one of said plurality of resonators, said input portion adapted to transversely couple with said first one of said plurality of resonators, an output portion spaced from a last one of said plurality of resonators, said output portion adapted to transversely couple with said last one of said plurality of resonators; and an enclosure substantially covering said plurality of resonators, said enclosure adapted to operate as a pseudo-wave guide having a cut off frequency above the operating frequency of said high frequency filter.

22. The electronic system of claim 21 wherein said enclosure is open-ended substantially near at least one of said input portion and said output portion.

23. The electronic system of claim 21, wherein said high frequency filter is adapted to operate in a frequency range between 1 GHz and 25 GHz.

24. The electronic system of claim 23, wherein said dielectric block has a thickness ranging from about 200 mils to about 15 mils.

25. The electronic system of claim 21, wherein said dielectric block has a thickness of between 200 mils and 15 mils and the microstrip filter is adapted to operate in a frequency range between 1 GHz and 25 GHz.

26. A high frequency filter comprising:

a dielectric substrate having a top surface and a bottom surface, the thickness of said dielectric substrate, from said top surface to said bottom surface, being at least one-twentieth of the high frequency filter's pass-band frequency's wavelength in said dielectric substrate, a plurality of resonators spaced from each other on said top surface and adapted to be longitudinally coupled;

an input portion spaced from a first one of said plurality of resonators, said input portion adapted to transversely couple with said first one of said plurality of resonators, an output portion spaced from a last one of said plurality of resonators, said output portion adapted to transversely couple with said last one of said plurality of resonators; and an enclosure substantially covering said plurality of resonators, said enclosure adapted so operate as a pseudo-wave guide having a cut off frequency above the operating frequency of said high frequency filter.

27. The high frequency filter of claim 26, wherein said high frequency filter is adapted to operate in a frequency range between 1 GHz and 25 GHz.

28. The high frequency filter of claim 27, wherein said dielectric block has a thickness ranging from about 200 mils to about 15 mils.

29. The high frequency filter a claim 26, wherein said dielectric block has a thickness of between 200 mils and 15 mils and the microstrip filter is adapted to operate in a frequency range between 1 GHz and 25 GHz.

30. A microstrip filter adapted to operate in a frequency range between 1 and 100 GHz, said microstrip filter comprising:

a plurality of resonators having at least one of a longitudinal gap and a transverse gap between each one of said plurality of resonators, a dielectric block having said plurality of resonators on a first side, said dielectric block having a thickness of a least one-twentieth of the microstrip filter's pass-band frequency's wavelength in the dielectric block; and a covering that at least partially covers said plurality of resonators, said covering adapted to operate as a pseudo waveguide having a cutoff frequency that is higher than an operating frequency of said microstrip filter.

31. The microstrip filter of claim 30, wherein said microstrip filter is adapted to operate in a frequency range between 1 GHz and 25 GHz.

32. The microstrip filter of claim 31, wherein said dielectric block has a thickness ranging from about 200 mils to 15 mils.

33. The microstrip filter of claim 30, wherein said dielectric block has a thickness ranging from about 200 mils to about 15 mil and said microstrip filter is adapted to operate in a frequency range between 1 GHz and 25 GHz.

34. A microstrip comprising:

a plurality of capacitively coupled resonators;

a dielectric block having said plurality of capacitively coupled resonators on at least a first side of said dielectric block, said dielectric block having a thickness of at least one-twentieth of the microstrip filter's pass-band frequency's wavelength in the dielectric block; and a covering over at least a portion of said plurality of capacitively coupled resonators, said covering adapted to function as a pseudo waveguide having a cutoff frequency that is higher than an intended operating frequency of said microstrip filter, said intended operating frequency being a selected frequency range between 1 GHz and 100 GHz.

35. The microstrip filter of claim 34, wherein said microstrip filter is adapted to operate in a frequency range between 1 GHz and 25 GHz.

36. The microstrip filter of claim 35, wherein said dielectric block has a thickness ranging from about 200 mils to 15 mils.

37. The microstrip filter of claim 34, wherein said dielectric block has a thickness of between 200 mils and 15 mils and the microstrip filter is adapted to operate within a frequency range of 1 GHz to 25 GHz.

* * * * *